US008263905B2

(12) United States Patent
Kim et al.

(10) Patent No.: US 8,263,905 B2
(45) Date of Patent: Sep. 11, 2012

(54) HEAT GENERATION SHEET AND METHOD OF FABRICATING THE SAME

(75) Inventors: Sangsig Kim, Seoul (KR); Kyoungah Cho, Seoul (KR); Kiju Im, Yangju (KR)

(73) Assignee: Kiju Im, Cheongju-Si, Chungcheongbuk-Do (KR)

( * ) Notice: Subject to any disclaimer, the term of this patent is extended or adjusted under 35 U.S.C. 154(b) by 148 days.

(21) Appl. No.: 12/368,337

(22) Filed: Feb. 10, 2009

(65) Prior Publication Data

US 2009/0262175 A1 Oct. 22, 2009

(30) Foreign Application Priority Data

Apr. 16, 2008 (KR) ..... 10-2008-0035211

(51) Int. Cl.
*H05B 1/00* (2006.01)
*H05B 3/12* (2006.01)

(52) U.S. Cl. ..... 219/200

(58) Field of Classification Search ..... 219/200, 219/201, 203
See application file for complete search history.

(56) References Cited

U.S. PATENT DOCUMENTS

| | | | | |
|---|---|---|---|---|
| 7,507,447 | B2 | 3/2009 | Hirai et al. | |
| 2004/0265602 | A1 | 12/2004 | Kobayashi et al. | |
| 2006/0096967 | A1 | 5/2006 | Weiss | |
| 2006/0186104 | A1 | 8/2006 | Winter | |
| 2009/0065734 | A1 * | 3/2009 | Yoon et al. | 252/73 |

FOREIGN PATENT DOCUMENTS

| | | | |
|---|---|---|---|
| EP | 2112868 | * | 10/2009 |
| JP | 1990-033882 | | 2/1990 |
| JP | 2000-100548 | | 4/2000 |
| JP | 2003-249123 | | 9/2003 |
| JP | 2005-202414 | | 7/2005 |
| JP | 2006-091449 | | 4/2006 |
| JP | 2009-219089 | * | 9/2009 |

OTHER PUBLICATIONS

Machine-generated translation of JP 2003-249123, published on Sep. 2003.*

Machine-generated translation of JP 2000-100548, published on Apr. 2000.*

European Search Report dated Apr. 27, 2010.

Japanese Office Action, and English translation, issued in corresponding JP Patent Application No. 2009-27852, dated Sep. 13, 2011.

* cited by examiner

*Primary Examiner* — Huan Tran

(74) *Attorney, Agent, or Firm* — Buchanan Ingersoll & Rooney PC

(57) ABSTRACT

Provided are a heat generation sheet and a method of fabricating the same. The heat generation sheet includes: a base comprising first and second sides; a heat generation layer which is formed in at least one region of the first side of the base and in which a plurality of conductive nanoparticles are physically necked; a protective layer protecting the heat generation layer; and an electric feeding part supplying power to the heat generation layer. The heat generation layer is formed by coating and heat treating a nanoparticle dispersion solution.

16 Claims, 7 Drawing Sheets

HEAT GENERATION SHEET AND METHOD OF FABRICATING THE SAME

CROSS-REFERENCE TO RELATED APPLICATIONS

This application claims the benefit of Korean Patent Application No. 10-2008-0035221, filed on Apr. 16, 2008, in the Korean Intellectual Property Office, the disclosure of which is incorporated herein in its entirety by reference.

BACKGROUND

1. Technical Field

Example embodiments relate to a heat generation sheet and a method of fabricating the same, and more particularly, to a heat generation sheet having a nanoparticle heat generation layer and a method of fabricating the same.

2. Description of the Related Art

In general, in a structure in which high quality visualization is required, such as glass of a refrigeration display rack, glass for a motor vehicle, a bathroom mirror, or the like, generation of fog or frost due to a temperature difference needs to be alleviated, or fog or frost needs to be rapidly removed.

A heating line attached to an additional fan heater or the surface of glass is mainly used to remove fog or frost that is generated on glass or a mirror. A coating film for preventing fog, which is formed using a surfactant, may be used to remove fog or frost that is generated on glass or the mirror.

An example of a frost removing structure by using the heating line may be found in glass for the motor vehicle. Glass for the motor vehicle is a kind of heat sheet having a structure in which an opaque or a semitransparent electrical resistive line or heating line is formed on a transparent base such as safety glass or the like. The electrical resistive line of the heat sheet has non-uniform electrical resistance and thus causes a partial thermal difference. In addition, the electrical resistive line shields a field of vision, and heat is generated along the electrical resistive line. Thus, heat is slowly transferred to a portion in which the electrical resistive line is not disposed, and for example, frost cannot be uniformly removed.

A heat generation structure using a transparent conductive film has been proposed so as to prevent a problem of the electrical resistive line, i.e., disturbance of a field of vision and non-uniform heat generation. An example of a related transparent conductive film includes a compound thin film such as tin oxide or indium oxide or a metal thin film such as a precious metal or copper.

However, since a related heat generation thin film is formed using thermal deposition, physical deposition, chemical deposition, or the like, it is not easy to make the related heat generation thin film larger, and the number of processes is very large, and manufacturing cost increases.

SUMMARY

Example embodiments provide a heat generation sheet using nanoparticles and a method of fabricating the same.

According to example embodiments, there is provided a heat generation sheet, including: a base comprising first and second sides; a heat generation layer which is formed in at least one region of the first side of the base and in which a plurality of conductive nanoparticles are physically connected; a protective layer protecting the heat generation layer; and an electric feeding part supplying power to the heat generation layer.

According to example embodiments, there is provided a method of fabricating a heat generation sheet, the method including: coating a dispersion solution in which nanoparticles are dispersed on a solvent, on a first side of a base comprising first and second sides; forming a nanoparticle layer on the first side of the base by removing the solvent of the dispersion solution; forming a heat generation layer in which the nanoparticles are connected, by heat treating the nanoparticle layer; and forming a protective layer protecting the heat generation layer.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
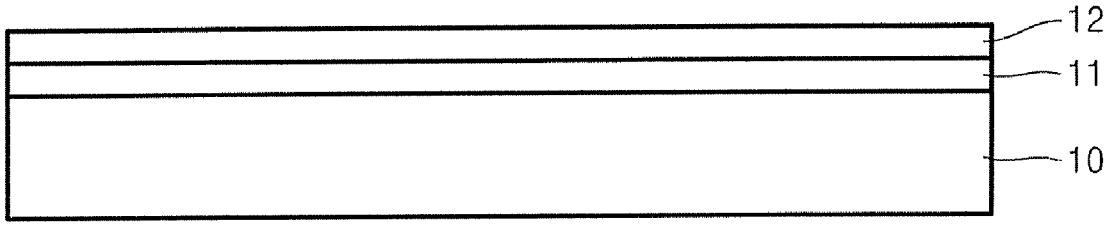
FIG. 1 illustrates a cross-sectional structure of a heat generation sheet according to an example embodiment.

Example embodiments now will be described more fully hereinafter with reference to the accompanying drawings, in which examples are illustrated. The present example embodiments may, however, have different forms and should not be construed as limited to the descriptions set forth herein. Rather, the embodiments are provided so that this disclosure will be thorough and complete, and will fully convey the scope of the embodiments to those skilled in the art. Like reference numerals in the drawings denote like elements. In the drawings, the thicknesses of layers and regions are exaggerated for clarity.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present example embodiments.

The terminology used herein is for the purpose of describing particular embodiments only and is not intended to be limiting of the present example embodiments. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the example embodiments belong. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the embodiments.

Hereinafter, example embodiments will be described in detail with reference to the accompanying drawings.

Figure 2:
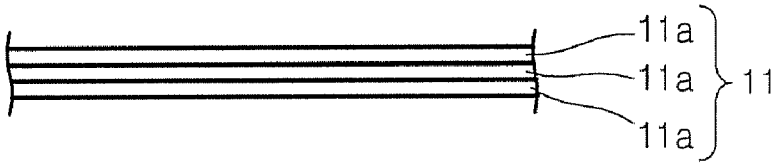
FIG. 2 illustrates a stack structure of a heat generation layer of the heat generation sheet illustrated in FIG. 1, according to an example embodiment.
Figure 3:
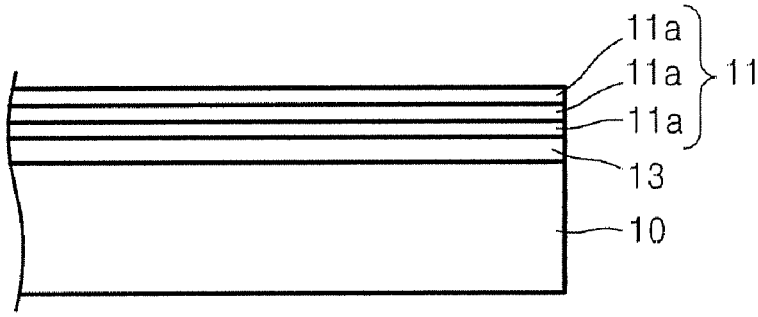
FIG. 3 illustrates a stack structure of a heat generation sheet according to another example embodiment.

FIG. 1 illustrates a basic structure of a heat generation sheet according to an example embodiment. FIG. 2 illustrates a stack structure of a heat generation layer of the heat generation sheet illustrated in FIG. 1, according to an example embodiment. FIG. 3 illustrates a stack structure of a heat generation sheet according to another example embodiment.

Referring to FIG. 1, a heat generation layer 11 and a protective layer 12 are sequentially stacked on a first side of a base 10.

The base 10 may be formed of a transparent, an opaque or a semitransparent material and may be formed of glass which is a transparent material, for example. The heat generation layer 11 may have a loose texture structure in which a plurality of conductive nanoparticles including silica or an oxide semiconductor are physically necked. The heat generation layer 11 may have a close-packed texture having no void according to heat treatment conditions in a method of fabricating a heat generation sheet that will be described later. In addition, the heat generation layer 11 may be in a complete film state according to another example embodiment. However, the loose texture of the heat generation layer 11 may be advantageous to implementing uniform resistance in the heat generation layer 11.

The protective layer 12 is formed of an insulating material so as to electrically and physically protect the heat generation layer 11.

The heat generation layer 11 may be a single layer but may have a stack structure in which a plurality of unit heat generation layers 11*a* are integrated as one body, as illustrated in FIG. 2. This is advantageous to obtaining a physical characteristic or an electrical characteristic that is required in a heat generation sheet, from one heat generation layer.

An adhesive force reinforcement layer 13 may be interposed between the heat generation layer 11 and the base 11 so as to firmly fix the heat generation layer 11 on the base 10. The adhesive force reinforcement layer 13 may be formed of silica or polymer containing conductive particles, for example, nanoparticles. The adhesive force reinforcement layer 13 may be a conductor having electrical resistance and thus may function as an element constituting the heat generation layer 11. The adhesive force reinforcement layer 13 is a selective element, and illustration thereof may be omitted in the description and the drawings as occasion demands.

Figure 4:
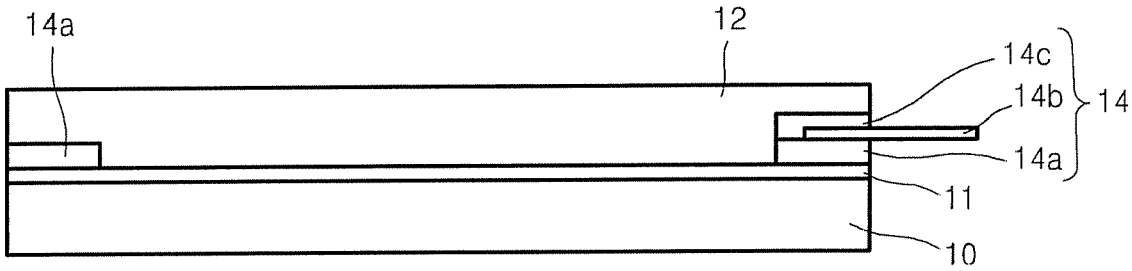
FIG. 4 illustrates a stack structure of a heat generation sheet according to another example embodiment.

FIG. 4 illustrates a heat generation sheet according to another example embodiment. A heat generation layer 11 is formed on a base 10, and an electric feeding part 14 including an electrode 14*a*, a conductive line 14*b*, a connection part or terminal 14*c* is formed at both sides of the heat generation layer 11. In FIG. 4, the electrode 14*a* which is a main element of the electric feeding part 14 directly contacts the heat generation layer 11, and the conductive line 14*b* is used to connect the heat generation layer 11 to an external circuit, and the terminal 14*c* is used to stably fix the conductive line 14*b* on the electrode 14*a*. A protective layer 12 is disposed on the heat generation layer 11. The protective layer 12 covers the electric feeding part 14 including the electrode 14*a* formed at both sides of the heat generation layer 10 and may not cover the electric feeding part 14 according to another example embodiment. The electrode 14*a* of the electric feeding part 14 is symbolically illustrated in the following drawings, and illustration of the other elements will be omitted for avoidance of complexity of the drawings.

Figure 5A:
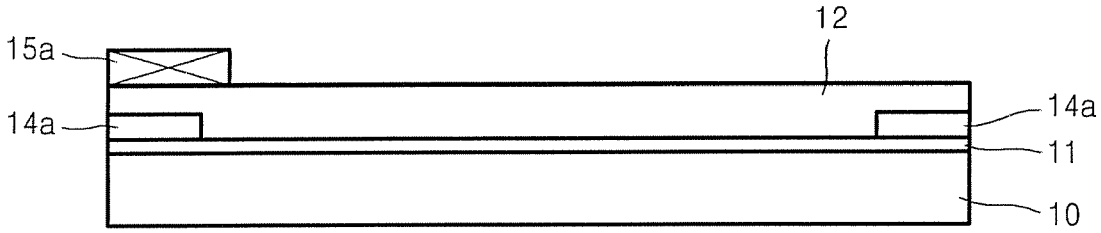
FIGS. 5A and 5B illustrate a stack structure of a heat generation sheet including a temperature/humidity sensor, according to other example embodiments, respectively.
Figure 5B:
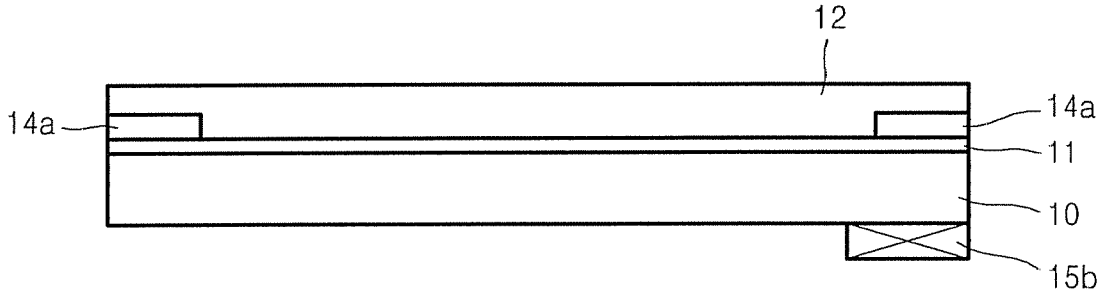

FIGS. 5A and 5B illustrate a heat generation sheet according to other example embodiments, respectively. A basic structure of the heat generation sheet illustrated in FIG. 5A or 5B is the same as that of the heat generation sheet illustrated in FIG. 4. The only difference is that the heat generation sheet illustrated in FIG. 5A or 5B includes a temperature sensor, a humidity sensor or a temperature/humidity sensor 15*a* or 15*b* which detects temperature and humidity. The heat generation sheet illustrated in FIG. 5A includes the sensor 15*a* that is disposed at a first side of the base 10, and the heat generation sheet illustrated in FIG. 5B includes the sensor 15*b* that is disposed at a second side of the base 10.

In FIG. 4, the heat generation sheet has the entire surface heat generation structure in which the heat generation layer 11 is formed on the entire surface of the base 10. However, according to the current embodiment, the first side of the base 10 may be divided into or defined as a plurality of regions and may be formed only a region of the defined, plurality of regions or a discretionally-selected plurality of regions.

Figure 6A:
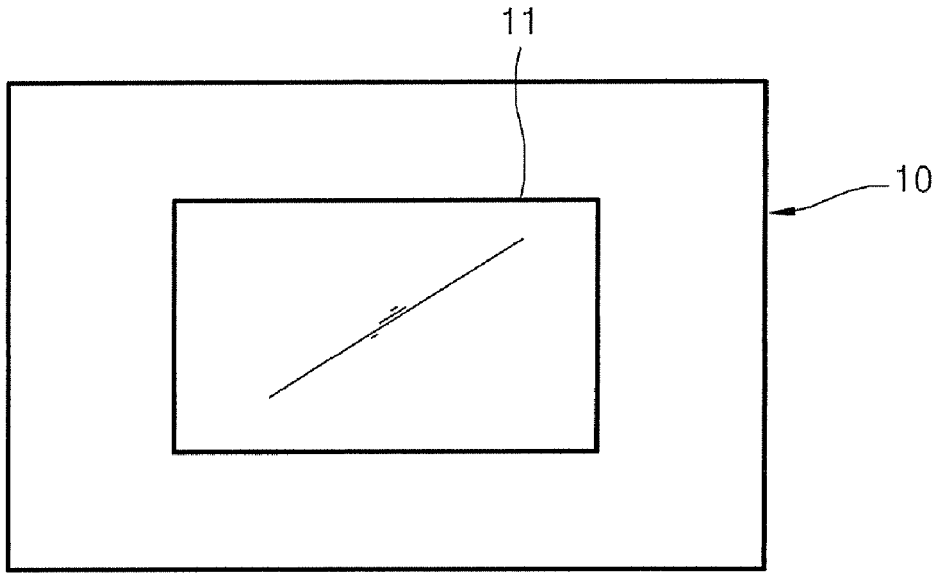
FIGS. 6A and 6B illustrate a planar arrangement shape of a heat generation layer on a base of a heat generation sheet according to other example embodiments, respectively.

FIG. 6A illustrates a heat generation sheet in which, when the first side of the base 10 is defined as a middle rectangular region and a frame region around the middle rectangular region, the heat generation layer 11 is formed only in the middle rectangular region, according to an example embodiment. In this regard, the region of the heat generation layer 11 may be greatly enlarged by adjusting the width of the frame region in which the heat generation layer 11 is not formed. This case is efficient when heat generation is not required and the frame region needs to be remained as a fixing part for fixing the heat generation layer 11 on other structure.

Figure 6B:
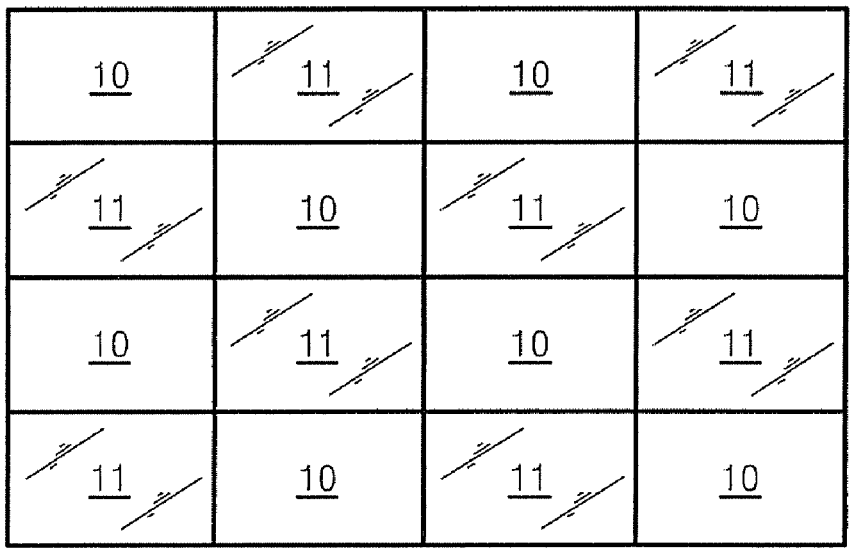

FIG. 6B illustrates a heat generation sheet in which a baduk board-shaped region is formed due to a defining line in which the first side of the base 10 is disposed in a lattice form and the heat generation layer 11 is arranged in the form of diamond. This symbolically illustrates that the first side of the base 10 is divided into or defined as a plurality of regions and the heat generation layer 11 may be selectively formed on the entire region.

The heat generation sheet having the above structure may be applied in various fields, for example, to external glass for a building, windows and doors, a bathroom mirror, right and left and front and rear windows for a motor vehicle or a screen for protecting the surface of a display installed outdoors. The heat generation sheet may include the base 10 formed of a transparent, semitransparent or an opaque material. In addition, the heat generation layer 11 and the protective layer 12 may have a transparent, semitransparent or an opaque structure according to applied targets. The base 10 may be a sheet in various forms and may have a dented form, for example, a semi-cylindrical or semispherical form. However, the example embodiment is not limited thereto.

Hereinafter, a method of fabricating a heat generation sheet according to other example embodiments will be described.

The base 10 is a sheet formed of a transparent, semitransparent or an opaque material in a flat, semi-cylindrical or semispherical form. Plastics or glass may be used to form the base 10.

The heat generation layer 11 formed on the base 10 includes at least one unit heat generation layer 11*a*, as described above. An adhesive force reinforcement layer 13 formed of a material that is strongly adhered to the base 10 may be formed beneath the heat generation layer 11*a*.

The adhesive force reinforcement layer 13 may be formed of a nanoparticle dispersion solution that is strongly adhered to the base 10, by using a spray coating process, a spin coating process, a dipping process, a brushing process or other wet coating methods.

Nanoparticles are dispersed into a solvent. Thus, it is easy to coat the nanoparticles on the large-sized base 10, and it is easy to adjust the thickness of the base 10 by adjusting the number of layers of the base 10. In addition, concentration of the nanoparticles in the nanoparticle dispersion solution is adjusted so that conductivity of the heat generation layer 11 can be easily adjusted.

In case of a heat generation sheet in which light transmittance is required, the adhesive force reinforcement layer 13 and the heat generation layer 11 may be formed of a material having a band gap energy of 3.3 eV or more because they do not absorb visible rays having a wavelength of 400 to 700 nm.

The adhesive force reinforcement layer 13 and the heat generation layer 11 are formed by coating the nanoparticle dispersion solution on the entire surface or a portion of the surface of the base 10 and by performing heat treatment thereon. The process of coating and performing heat treatment of the nanoparticle dispersion solution may be performed once or more so that a heat generation layer can be formed in a multi-layer structure. The conductive nanoparticle dispersion solution used to form the heat generation layer 11 may be prepared by using a spray coating process, a spin coating process, a dipping process, a brushing process or other wet coating methods. A film formed using the nanoparticle dispersion solution is dried through heat treatment, and nanoparticles that remain after drying are heated to be close to a melting point of the nanoparticles and are sintered so that the adhesive force reinforcement layer 13 and the heat generation layer 11 having a loose texture or a close-packed texture can be formed. Temperature for heat treatment depends on a diameter of the nanoparticles and decreases as the diameter of the nanoparticles decreases.

In the method of fabricating the heat generation sheet through which the dispersion solution of the nanoparticles is coated and is heat treated, thereby forming the heat generation layer, heat treatment can be performed at a lower temperature than a related method of forming a metal thin layer.

A region to be coated of the nanoparticle layer that is formed on the base 10 using the nanoparticle dispersion solution may be heat treated by using a hot plate or an oven. Temperature in this case may be in the range of 200 to 500° C. In heat treatment using a hot plate, a plurality of hot plates are disposed on and beneath the base 10 so that radiation heat can be transferred to both sides of the base 10.

The thickness of the heat generation layer 11 is adjusted to be less than 100 nm in consideration of visible light transmittance so that the heat generation layer 11 that is transparent with respect to the visible rays can be formed.

The electrode 14*a* or the terminal 14*c* of the electric feeding part 14 may be formed using a conductive material, such as a metal material, conductive epoxy, conductive paste, solder, a conductive film, or the like. The electrode 14*a* formed of a metal material may be formed through deposition, and the electrode 14*a* formed of conductive epoxy or conductive paste may be formed through screen printing, and the electrode 14*a* formed of solder may be formed through soldering, and the electrode 14*a* formed of a conductive film may be formed through laminating.

The conductive line 14*b* may be formed by wire bonding or soldering so as to be connected to the electrode 14*a*.

The protective layer 12 is formed above the heat generation layer 11 formed on the base 10 and the electric feeding part 14 including the electrode 14*a* and protects the heat generation layer 11 and the electric feeding part 14 from an external environment.

The protective layer 12 is formed of a dielectric oxide, perylene nanoparticles, a polymer film, or the like. The protective layer 12 formed of a dielectric oxide or perylene may be formed by deposition, and the protective layer 12 including nanoparticles may be formed by using a spray coating process, a spin coating process, a dipping process, a brushing process or other wet coating methods.

The above-described temperature, humidity or temperature/humidity sensor 15*a* or 15*b* transmits a detected signal to an additional feedback circuit so that heat generation caused by the heat generation layer 11 is feedback controlled and heat generation can be properly performed according to a change of temperature or humidity and fog or frost can be removed.

The electric feeding part 14 formed above the base 10 may be interposed between the adhesive force reinforcement layer 13 and the heat generation layer 11. In this case, the electrode 14*a* of the electric feeding part 14 is formed on the adhesive force reinforcement layer 13 and then, the heat generation layer 11 is formed. In this regard, the heat generation layer 11 may be formed only a portion which deviates from the electric feeding part 14, so as to form the terminal 14*c* or the conductive line 14*b* later.

Hereinafter, a method of fabricating a heat generation sheet according to other example embodiments will be described.

Figure 7:
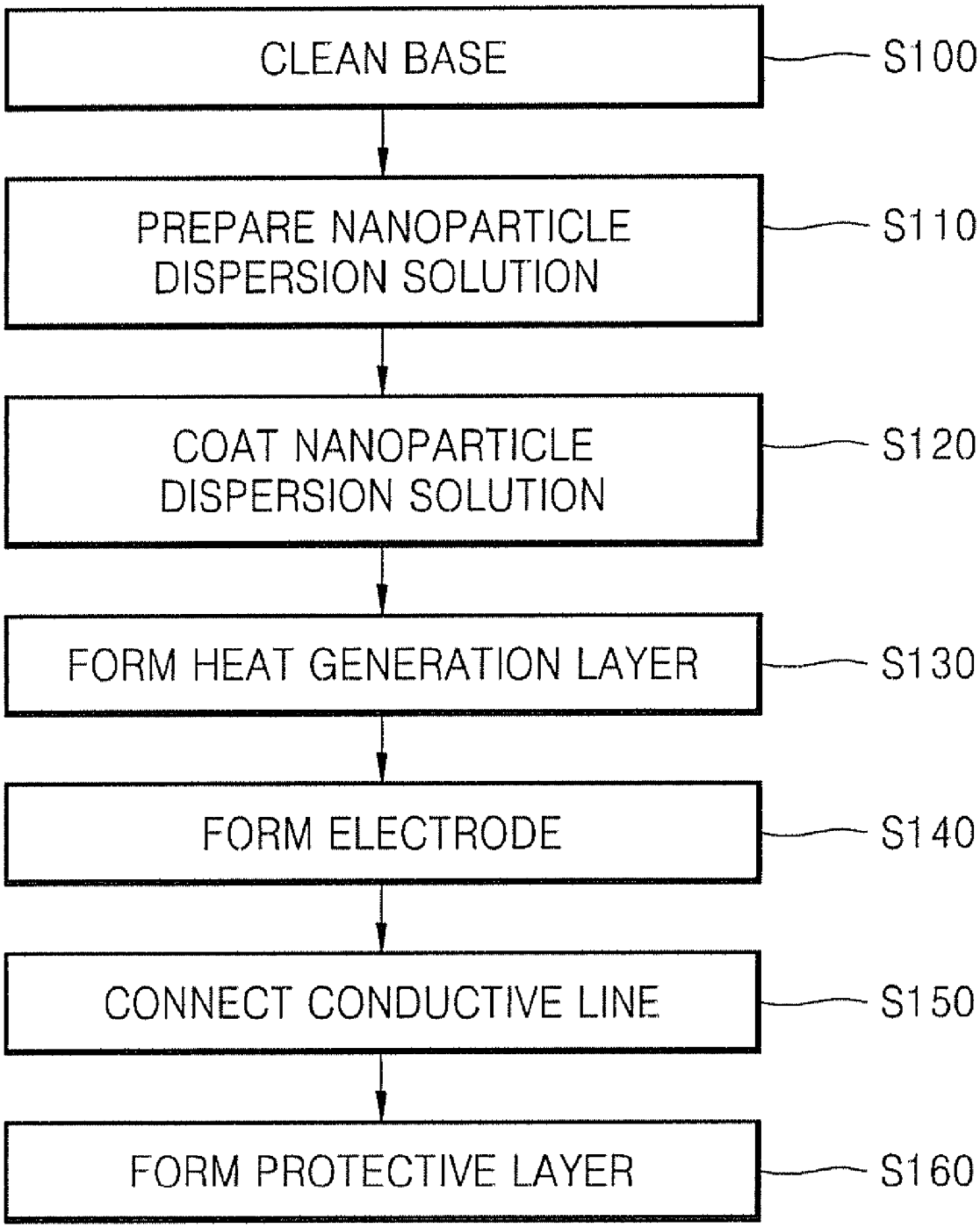
FIG. 7 is a flowchart illustrating a method of fabricating a heat generation sheet according to an example embodiment.

FIG. 7 illustrates a basic operation of the method of fabricating the heat generation sheet according to an example embodiment.

Operation S100:

The base 10 is cleaned by using a well-known solvent or etchant corresponding to a material for forming the base 10.

Operation S110:

A nanoparticle dispersion solution is prepared separately from the cleaning operation. Operation S110 is performed simulatanously with the operation of cleaning the base 10 and may be generally performed prior to the operation of cleaning the base 10. A solvent such as a mixture of methanol and calcium hydroxide or benzene may be used in the operation of preparing the nanoparticle dispersion solution. Nanoparticles including at least one of ZnO, SnO, MgO, and InO as a doped oxide semiconductor or at least one silica may be used in the operation of preparing the nanoparticle dispersion solution. At least one of In, Sb, Al, Ga, C, and Sn may be used as a dopant. The above-mentioned oxide semiconductor nanoparticles are added as a precursor in the state where the solvent is heated at 50-200° C. in the operation of preparing the nanoparticle dispersion solution.

Operation S120:

The nanoparticle dispersion solution is coated on the cleaned base 10. Various coating methods as described above may be used, and a region to be coated is the entire region of the base 10 or at least one region defined in the base 10.

Operation S130:

The nanoparticle dispersion solution is coated and then is heat treated, thereby forming the heat generation layer 11 due to nanoparticles. In this regard, a solvent in which the nanoparticles are dispersed due to heat treatment is evaporated (dried). In some cases, evaporation of the solvent may be separately performed. However, generally, evaporation of the solvent may be performed simultaneously with heat treatment. However, drying is first performed during heat treatment and sintering of the nanoparticles that remain after drying is performed so that the heat generation layer 11 in which the nanoparticles are physically connected can be formed.

Operation S140:

The electrode 14*a* is formed on the heat generation layer 11. The electrode 14*a* may be formed using metal, conductive epoxy, conductive paste, solder, a conductive film, or the like. The electrode 14*a* formed of metal may be formed through deposition, and the electrode 14*a* formed of conductive epoxy or conductive paste may be formed through screen printing, and the electrode 14*a* formed of solder may be formed through soldering, and the electrode 14*a* formed of a conductive film may be formed through laminating.

Operation S150:

The conductive line 14*b* is connected to the electrode 14*a* by using the above-described method. The conductive line 14*b* may be formed by wire bonding or soldering so as to be connected to the electrode 14*a*.

Operation S160:

Last, the protective layer 12 is formed on the heat generation layer 11. The protective layer 12 may be formed of a dielectric oxide, perylene nanoparticles, a polymer film, or the like. The protective layer 12 formed of a dielectric oxide or perylene may be formed by deposition, and the protective layer 12 including nanoparticles may be formed by using a spray coating process, a spin coating process, a dipping process, or the like.

Operations S120 and S130 described above are performed a plurality of times so that the heat generation layer 11 in a multi-layer structure can be formed. According to another example embodiment, operation S140 of forming the electrode 14*a* may be performed prior to operation S120. In this case, the electrode 14*a* may be electrically connected to the heat generation layer 11 while being placed beneath the heat generation layer 11.

Figure 8:
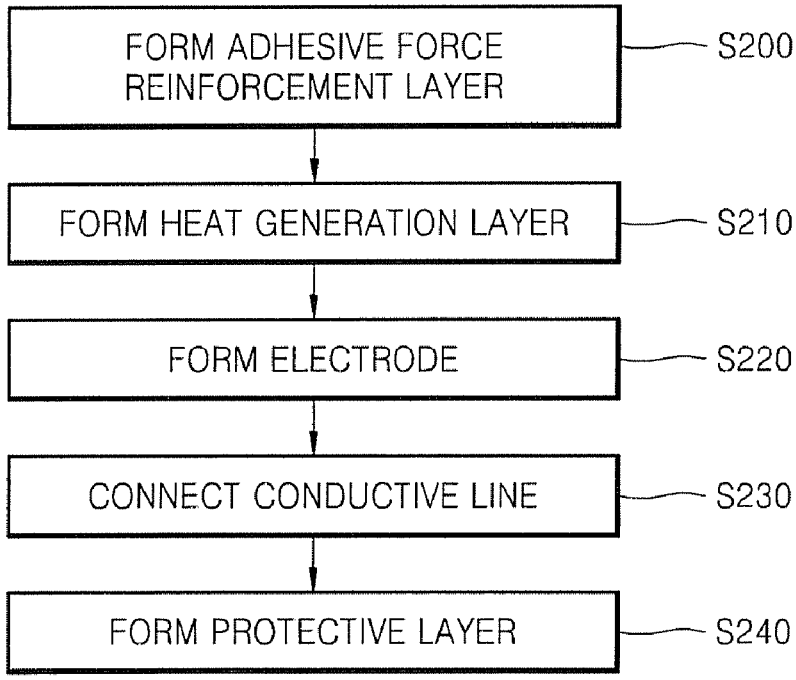
FIG. 8 is a flowchart illustrating a method of fabricating a heat generation sheet according to another example embodiment.

FIG. 8 illustrates a method of fabricating the heat generation sheet according to another example embodiment.

Operation S200:

A first dispersion solution in which separately-prepared nanoparticles are dispersed on the cleaned base 10 is coated and is dried/heat treated, thereby forming the adhesive force reinforcement layer 13. A solvent such as a mixture of methanol and calcium hydroxide or benzene may be used in the current operation. Nanoparticles including at least one of ZnO, SnO, MgO, and InO as an oxide semiconductor or at least one silica may be used in the current operation. The oxide semiconductor may include a dopant. At least one of In, Sb, Al, Ga, C, and Sn may be used as the dopant. The above-mentioned oxide semiconductor nanoparticles are added as a precursor in the state where the solvent is heated at 50-200° C. in the operation of preparing the nanoparticle dispersion solution.

Operation S210:

A second dispersion solution in which nanoparticles are dispersed on the adhesive force reinforcement layer 13 is coated and is dried/heat treated, thereby forming the heat generation layer 11. The second dispersion solution may include different nanoparticles from those of the first dispersion solution, and a solvent for forming the second dispersion solution may be different from the solvent for forming the first dispersion solution. The solvent such as a mixture of methanol and calcium hydroxide or benzene may be used in the current operation. Nanoparticles including at least one of ZnO, SnO, MgO, and InO as an oxide semiconductor or at least one silica may be used in the current operation. The oxide semiconductor may include a dopant. At least one of In, Sb, Al, Ga, C, and Sn may be used as the dopant. The above-mentioned oxide semiconductor nanoparticles are added as a precursor in the state where the solvent is heated at 50-200° C. in the operation of preparing the nanoparticle dispersion solution.

A region to be coated, of each of the adhesive force reinforcement layer 13 and the heat generation layer 11 may be the entire region of the base 10 or at least one region defined in the base 10. The adhesive force reinforcement layer 13 and the heat generation layer 11 may not coincide with each other. For example, the adhesive fore reinforcement layer 10 may be coated on the entire region of the base 10 or a portion thereof, and the heat generation layer 11 may be coated on the entire region of the adhesive force reinforcement layer 13 or on at least one region of the adhesive force reinforcement layer 13.

When the coated second dispersion solution is heat treated, a solvent in which nanoparticles are dispersed is evaporated. In some cases, evaporation of the solvent may be separately performed. However, generally, evaporation of the solvent may be performed simultaneously with heat treatment. However, drying is first performed during heat treatment and sintering of the nanoparticles that remain after drying is performed so that the heat generation layer 11 in which the nanoparticles are physically connected can be formed. In this case, the heat generation layer 11 has a physical connection structure due to the connected nanoparticles, and voids may exist in the structure. In some cases, the heat generation layer 11 may have a close-packed texture having no void.

Operation S220:

The electrode 14*a* is formed on the heat generation layer 11. The electrode 14*a* may be formed using metal, conductive epoxy, conductive paste, solder, a conductive film, or the like. The electrode 14*a* formed of metal may be formed through deposition, and the electrode 14*a* formed of conductive epoxy or conductive paste may be formed through screen printing, and the electrode 14*a* formed of solder may be formed through soldering, and the electrode 14*a* formed of a conductive film may be formed through laminating.

Operation S230:

The conductive line 14*b* is connected to the electrode 14*a* by using the above-described method. The conductive line 14*b* may be formed by wire bonding or soldering so as to be connected to the electrode 14*a*.

Operation S240:

Last, the protective layer 12 is formed on the heat generation layer 11. The protective layer 12 may be formed of a dielectric oxide, perylene nanoparticles, a polymer film, or the like. The protective layer 12 formed of a dielectric oxide or perylene may be formed by deposition, and the protective layer 12 including nanoparticles may be formed by using a spray coating process, a spin coating process, a dipping process, or the like.

Operations S200 and S210 described above are performed a plurality of times so that the adhesive fore reinforcement layer 13 and the heat generation layer 11 each having a multi-layer structure can be formed. According to another example embodiment, operation S220 of forming the electrode 14*a* may be performed prior to operation S120. In this case, the electrode 14*a* may be electrically connected to the heat generation layer 11 while being placed beneath the heat generation layer 11.

Figure 9:
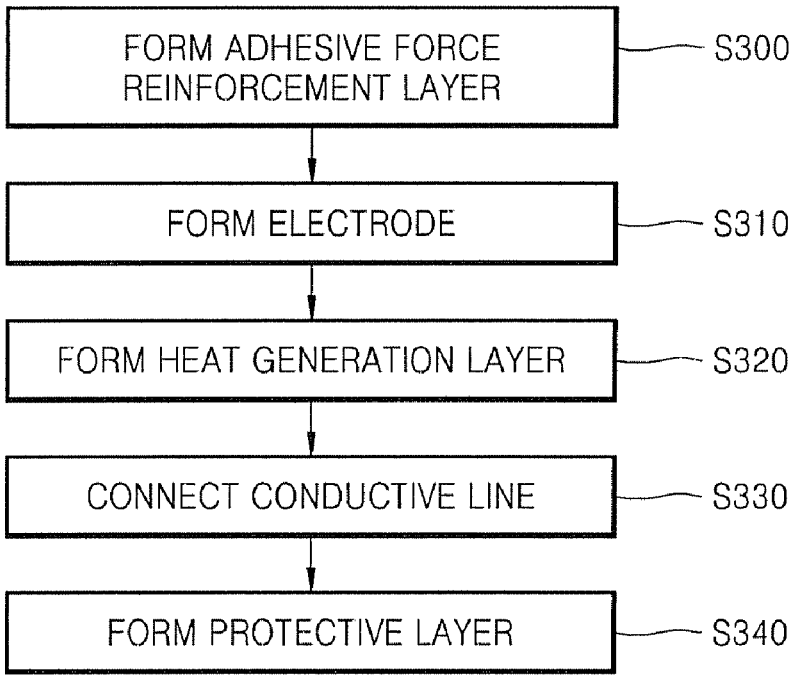
FIG. 9 is a flowchart illustrating a method of fabricating a heat generation sheet according to another example embodiment.

FIG. 9 illustrates a method of fabricating the heat generation sheet according to another example embodiment.

Operation S300:

The adhesive force reinforcement layer 13 is formed by using a first dispersion solution in which nanoparticles prepared on the above-described conditions are dispersed on the cleaned base 10. According to another example embodiment, the adhesive force reinforcement layer 13 may have a single layer or multi-layer structure. Here, the adhesive force reinforcement layer 13 may be formed of silica or polymer or by adding nanoparticles to silica or polymer according to another example embodiment. The adhesive force reinforcement layer 13 may be formed using various methods such as deposition, spin coating, or the like. In addition, the adhesive force reinforcement layer 13 may be formed of a transparent, an opaque or a semitransparent material.

Operation S310:

The electrode 14*a* is formed on the adhesive force reinforcement layer 13. The electrode 14*a* may be formed using metal, conductive epoxy, conductive paste, solder, a conductive film, or the like. The electrode 14*a* formed of metal may be formed through deposition, and the electrode 14*a* formed of conductive epoxy or conductive paste may be formed through screen printing, and the electrode 14*a* formed of solder may be formed through soldering, and the electrode 14*a* formed of a conductive film may be formed through laminating.

Operation S320:

A second dispersion solution that is prepared on the above-described conditions is coated on the adhesive force reinforcement layer 13 and the electrode 14*a* and is dried/heat treated, thereby forming the heat generation layer 11. The operation of forming the heat generation layer 11 may be repeatedly performed a plurality of times, and different nanoparticles or solvent may be used in the repeated operation.

Operation S330:

The conductive line 14*b* is connected to the electrode 14*a* by using the above-described method. The conductive line 14*b* may be formed by wire bonding or soldering so as to be connected to the electrode 14*a*.

Operation S340:

Last, the protective layer 12 is formed on the heat generation layer 11. The protective layer 12 may be formed of a dielectric oxide, perylene nanoparticles, a polymer film, or the like. The protective layer 12 formed of a dielectric oxide or perylene may be formed by deposition, and the protective layer 12 including nanoparticles may be formed by using a spray coating process, a spin coating process, a dipping process, or the like.

Operations S300 and S320 described above are performed a plurality of times so that the adhesive fore reinforcement layer 13 and the heat generation layer 11 each having a multi-layer structure can be formed. According to another example embodiment, operation S310 of forming the electrode 14*a* may be performed prior to operation S300. In this case, the electrode 14*a* may be electrically connected to the heat generation layer 11 while being placed beneath the adhesive fore reinforcement layer 13.

In the above-described embodiments, the heat generation layer 11 having a multi-layer structure may have a stack structure in which a plurality of unit heat generation layers 11*a* formed using different types of nanoparticles are integrated as one body. After the protective layer 12 is finally formed, an operation of disposing a temperature/humidity sensor and a feedback circuit on the protective layer 12 or on each of first and second sides of the base 10 may be further performed. However, the temperature/humidity sensor and the feedback circuit are selective elements, and the example embodiment is not limited thereto. In addition, a specific shape of the electric feeding part 14 for supplying power to the heat generation layer 11, for example, the location and shape of the electrode 14*a* and the shape and arrangement of the conductive line 14*b* may be implemented in various ways. This may be modified in various shapes whereby power is successfully supplied to the heat generation layer 11, and the example embodiment is also not limited thereto.

The heat generation sheet having the above structure and fabricated using the method according to the example embodiments can be fabricated in a simple structure and with low cost. Since the heat generation sheet is driven with low power consumed, efficient heat generation can be performed. The heat generation sheet includes the temperature/humidity sensor and thus can operate automatically before a user checks fog or like with naked eyes.

Hereinafter, an actual fabrication process for determining performance and implementability of the heat generation sheet according to the example embodiments and the result of performing the fabrication process will be described.

Indium tin oxide (ITO) sol containing nanoparticles was spin coated on glass D263 (manufactured by Schott Corporation) on conditions of 2,500 rpm and 30 seconds and then was dried at 80° C. so that an ITO layer was formed. The operation was performed 15 times so that the ITO layer having a surface resistance of 200 KΩ was formed in a multi-layer structure. After the ITO layer was heat treated at 200° C. for 5 minutes, a heat generation layer having visible light transmittance of 90% or more (based on glass) and a surface resistance of 600Ω was fabricated. A silver electrode was formed on the finally-formed heat generation layer by using a printing method, and a characteristic of a heater (heat generation layer) was checked.

As a result, when voltage of 30 V was applied to the ITO heat generation layer, a heating temperature of 230° C. was checked at consumed power 1 W/cm$^2$, and when voltage of 20 V was applied to the ITO heat generation layer, a heating temperature of 90° C. was checked at consumed power 0.8 W/cm$^2$, and when voltage of 10 V was applied to the ITO heat generation layer, a heating temperature of 45° C. was checked at consumed power 0.5 W/cm$^2$.

Figure 10A:
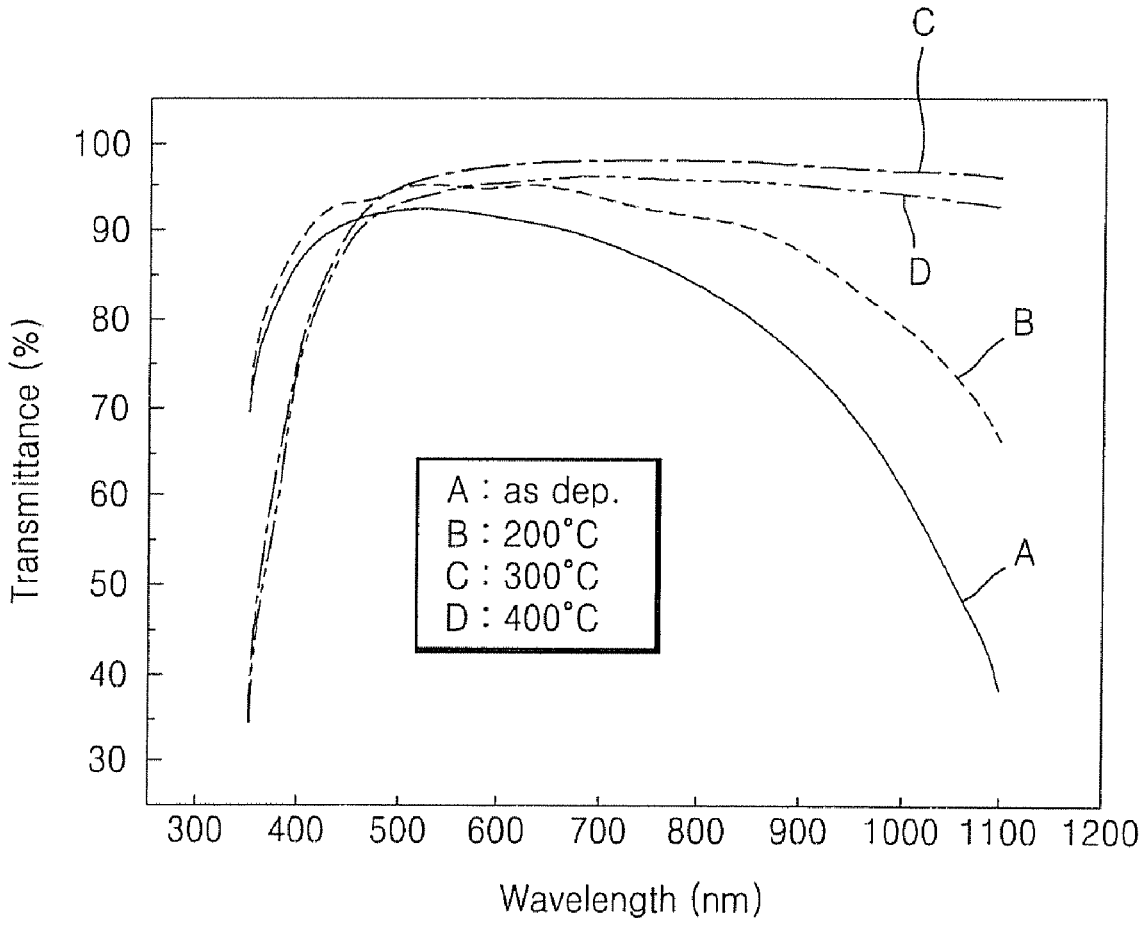
FIGS. 10A and 10B are graphs showing optical and electrical characteristics of a heat generation layer that is actually formed according to the example embodiment.
Figure 10B:
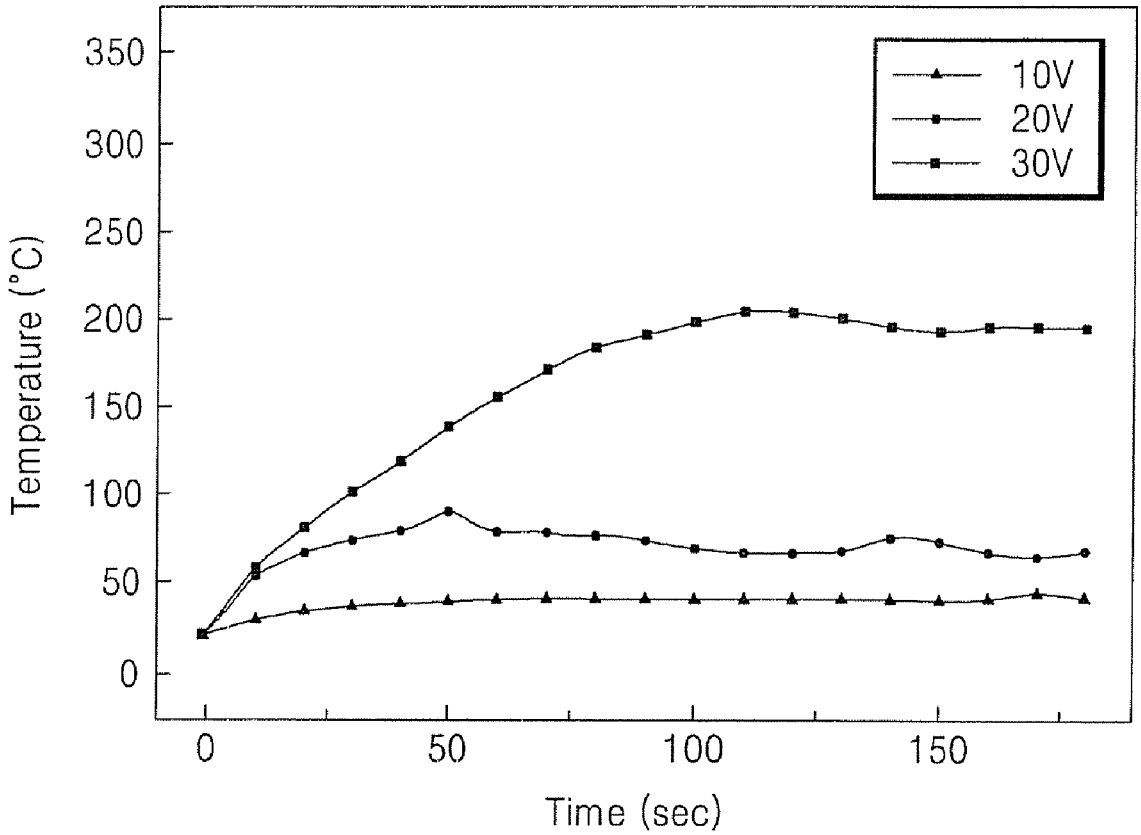

FIG. 10A is a graph showing a change of wavelength (nm) versus transmittance (%) before and after the ITO layer having a multi-layer structure is heat treated according to heat treatment temperatures 200° C., 300° C., and 400° C., respectively, and FIG. 10B is a graph showing a change of time (sec) versus temperature (° C.) according to voltages 10 V, 20 V, and 30 V, respectively, applied to the ITO heat generation layer having a multi-layer structure and heat treated at 400° C.

As described above, in the heat generation sheet and the method of fabricating the same according to the example embodiments, a thin film including nanoparticles is used as a transparent heat generation body unlike a related transparent surface type heater, such that the heat generation sheet can be fabricated in a simple fabrication process and a conductive nano thin film heat generation body can be easily formed to have a large size.

In addition, by using the large-sized transparent surface type heater according to the example embodiments, water vapor that is generated on the surface of a bathroom mirror can be removed, and water vapor that is generated on the surface of front, rear, side glass or a back mirror of a motor vehicle can be easily removed, and water vapor that is generated on the wall surface of glass that constitutes an external wall of a building can be easily removed.

In addition, according to the example embodiments, the transparent surface type heater operates before a user checks fog or the like with naked eyes such that fog or the like can be prevented from being generated. As such, when the large-sized transparent surface type heater is used on the base which requires light transmittance but in which light transmittance is disturbed due to fog or the like, temperature of the base can be controlled while light transmittance is maintained such that fog or frost can be efficiently removed.

It should be understood that the example embodiments described therein should be considered in a descriptive sense only and not for purposes of limitation. Descriptions of features or aspects within each embodiment should typically be considered as available for other similar features or aspects in other embodiments.

What is claimed is:

1. A heat generation sheet comprising:

a base comprising first and second sides;

a heat generation layer which is formed in at least one region of the first side of the base and in which a plurality of conductive nanoparticles comprising at least one of oxide semiconductor material doped with dopant and silica are physically connected;

a protective layer protecting the heat generation layer; and an electric feeding part supplying power to the heat generation layer.

2. The heat generation sheet of claim 1, wherein the oxide semiconductor material comprises at least one oxide selected from the group consisting of ZnO, SnO, MgO, and Ino.

3. The heat generation sheet of claim 2, wherein the dopant comprises at least one selected from the group consisting of In, Sb, Al, Ga, C, and Sn.

4. The heat generation sheet of claim 1, wherein the heat generation layer comprises a multi-layer structure comprising a plurality of unit layers.

5. The heat generation sheet of claim 1, wherein the heat generation layer is formed in at least one region of a plurality of regions defined in the first side of the base.

6. The heat generation sheet of claim 1, further comprising an adhesive force reinforcement layer interposed between the heat generation layer and the base.

7. The heat generation sheet of claim 6, wherein the adhesive force reinforcement layer comprises a plurality of nanoparticles connected.

8. A heat generation sheet comprising:

a base comprising first and second sides;

a heat generation layer which is formed in at least one region of the first side of the base and in which a plurality of conductive nanoparticles comprising at least one of oxide semiconductor material doped with dopant and silica are physically connected;

a protective layer protecting the heat generation layer; and an electric feeding part supplying power to the heat generation layer, wherein the heat generation layer comprises a plurality of unit heat generation layers formed using different types of nanoparticles.

9. A method of fabricating a heat generation sheet, the method comprising:

coating a dispersion solution in which nanoparticles comprising at least one of oxide semiconductor material doped with dopant and silica are dispersed on a solvent, on a first side of a base comprising first and second sides;

forming a nanoparticle layer on the first side of the base by removing the solvent of the dispersion solution;

forming a heat generation layer by heat treating the nanoparticle layer until the nanoparticles are physically connected; and forming a protective layer protecting the heat generation layer.

10. The method of claim 9, wherein the heat generation layer is formed in a multi-layer structure by repeatedly performing the coating of the dispersion solution, the forming of the nanoparticle layer by removing the solvent of the dispersion solution, and the forming of the heat generation layer by heat treating the nanoparticle layer a plurality of times.

11. The method of claim 10, before the forming of the nanoparticle layer, further comprising forming an adhesive force reinforcement layer reinforcing an adhesive force of the heat generation layer with respect to the base.

12. The method of claim 11, wherein the forming of the adhesive force reinforcement layer comprises:

coating the dispersion solution in which the nanoparticles are dispersed on the solvent, on the base; and drying the solvent and heat treating the nanoparticles.

13. The method of claim 9, before the forming of the nanoparticle layer, further comprising forming an adhesive force reinforcement layer reinforcing an adhesive force of the heat generation layer with respect to the base.

14. The method of claim 13, wherein the forming of the adhesive force reinforcement layer comprises:

coating the dispersion solution in which the nanoparticles are dispersed on the solvent, on the base; and drying the solvent and heat treating the nanoparticles.

15. The method of claim 9, wherein the oxide semiconductor material comprises at least one oxide selected from the group consisting of ZnO, SnO, MgO, and InO.

16. The method of claim 9,wherein the dopant comprises at least one selected from the group consisting of In, Sb, Al, Ga, C, and Sn.

* * * * *